United States Patent [19]

Gessler

[11] 3,985,323

[45] Oct. 12, 1976

[54] LEG EXTENDER FOR CHAIRS AND OTHER FURNITURE

[75] Inventor: Robert U. Gessler, Chapel Hill, N.C.

[73] Assignee: Easy Riser, Inc., Wilton, Conn.

[22] Filed: Aug. 7, 1975

[21] Appl. No.: 602,898

[52] U.S. Cl. ..... 248/188.9; 403/341

[51] Int. Cl.[2] ..... F16M 11/20

[58] Field of Search..... 248/188.2, 188.8, 188.9, 248/231; 16/30, 32, 42 T, 43; 403/286, 293, 341; 52/126; 24/263 R, 243 BH

[56] References Cited

UNITED STATES PATENTS

| | | | |
|---|---|---|---|
| 521,063 | 6/1894 | Wettstein et al. | 403/341 |
| 881,709 | 3/1908 | O'Leary | 403/286 |
| 2,107,629 | 2/1938 | Dallas | 248/188.2 |
| 2,448,817 | 9/1948 | McArthur | 403/341 |
| 2,513,889 | 7/1950 | Nilsson | 248/188.8 |
| 3,295,802 | 1/1967 | Leatherman | 248/188.8 |

*Primary Examiner*—Robert A. Hafer

*Attorney, Agent, or Firm*—B. B. Olive; Richard S. Faust

[57] ABSTRACT

A block of a predetermined height is adapted to be secured to the end of a chair, bed or other furniture leg as a means for extending the leg to a chosen length. A plurality of braces extend upwardly from the block and are secured to the leg by a conventional band-type clamp.

5 Claims, 11 Drawing Figures

LEG EXTENDER FOR CHAIRS AND OTHER FURNITURE

BACKGROUND OF THE INVENTION

1. Field of the Invention:

The invention relates to extenders for chair, bed and other furniture legs.

2. Description of the Prior Art:

A major problem for the arthritic patient is the transfer to and from his bed. This transfer is especially difficult when the height of the bed is so low that the patient has difficulty regaining his balance after the transfer. Doctors have recommended placing blocks under the bed legs to elevate the bed. The Allied Health Professions Section of The Arthritis Foundation, in recent publications, has suggested that the bed elevation can be raised by making blocks of wood with recesses to fit the bed legs. Each block has solid outer walls and a recess which is filled with sand or small blocks to bring the bed to the proper height. For stability, each leg is inserted into the recess for at least one-third of the block's height.

While the prior practice of elevating bed mattresses facilitates sliding-sitting transfers to and from wheelchairs by making the bed level with the wheelchair and enables the patient to stand more easily, it has recently been discovered by the present inventor that by raising the height of furniture to a specific height, pain and joint stress due to sitting and rising can be virtually eliminated. This exact height, which varies with each individual, is referred to as the "comfort zone". The comfort zone for most individuals is approximately 18 to 24 inches from the floor. In cases of chairs and sofas with soft cushions and beds with soft mattresses, the comfort zone is measured from the floor to the depressed position of the cushion or mattress. By elevating each article of furniture used, the arthritic patient can greatly reduce pain and joint stress, reduce his intake of medication and reduce the deterioration of his joints.

A safe and simple means for elevating the furniture leg has not been found in the prior art. The practice of placing chair or bed legs on books or wooden blocks is much too dangerous. The recessed block suggested by The Arthritis Foundation has to be custom made for each bed leg size and is too unstable for use on chairs. Thus, an acute need has developed for a leg extender which is safe and reliable and can fit a wide range of furniture leg sizes.

SUMMARY OF THE INVENTION

The apparatus of the invention is adapted to be secured to the end of a chair or bed leg and serves to extend the leg by a predetermined amount. Unlike previous leg elevation apparatus, the leg extender apparatus of the present invention forms a continuation of the chair or bed leg thereby preventing the chair or bed leg from falling off its supporting surface and causing injury to the occupant. The apparatus of the invention includes a block member of predetermined height to which are attached four adjustable, vertically-oriented braces which engage the outer surface of the chair leg. A clamp is used to bring the braces into tight engagement with the chair leg. The space between the braces can be adjusted to accommodate a wide range of leg sizes. Any degree of elevation may be achieved merely by using blocks having different heights. An open-ended tubular sleeve member can be provided to cover the metal parts of the apparatus and to give the leg extension an attractive appearance.

DESCRIPTION OF THE PREFERRED EMBODIMENT

Figure 1:
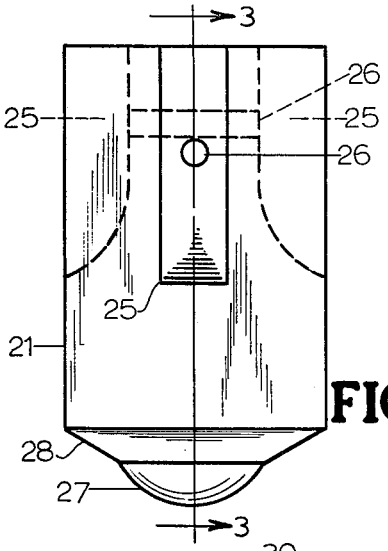
FIG. 1 is a side view of the leg extender block.
Figure 2:
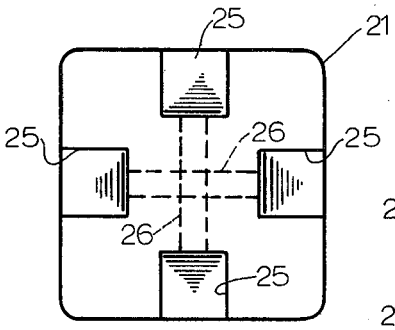
FIG. 2 is a top view of the block shown in FIG. 1.
Figure 3:
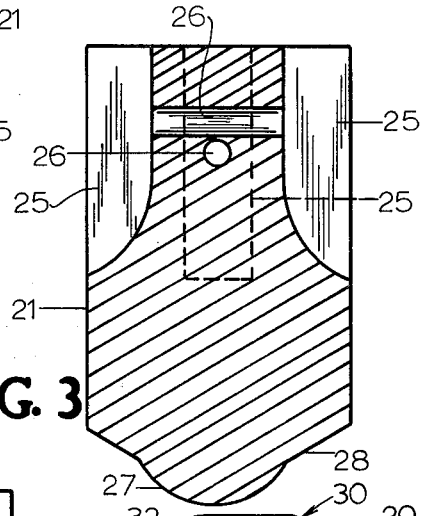
FIG. 3 is a section view of the block taken along line 3-3 of FIG. 1.

Referring to FIGS. 1, 2 and 3, leg extender 20 includes a block portion 21 of rectangular cross section and preferably formed of finished wood, though metal, rigid plastic, and similar materials may be used in lieu of wood. Each side of block 21 has a milledout recess area 25. A pair of horizontal holes 26 are drilled through block 21 which provides each recess area with a hole for receiving a brace, as later explained. The bottom of block 21 tapers along a sloped surface 28 to a knob portion 27 which is adapted to contact the floor.

Figures 4, 6:
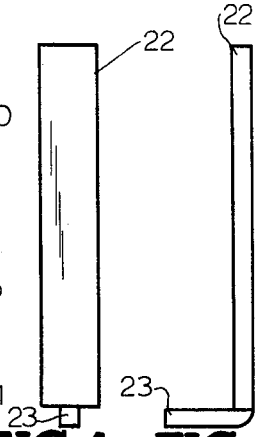
FIG. 4 is a front view of a metal brace which attaches to the block.
FIG. 6 is a side view of the brace showing the brace tail portion which fits into holes drilled in the leg extender block.
Figure 5:
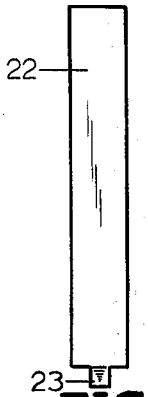
FIG. 5 is a rear view of the brace shown in FIG. 4.

FIGS. 4, 5 and 6 illustrate one of the braces of the present invention. Brace 22 is a rigid metal strip which has at its lower end an outwardly protruding tail 23. A brace 22 is adapted to fit into each recess 25 by pressing tail 23 into the end of one of holes 26. Thus, leg extender 20 has four vertical braces extending above block 21 and adapted to engage the outer surfaces of the chair leg. The area within the four braces 22 can be varied to accommodate various size chair legs by allowing the distance the respective tails 23 are inserted into holes 26 to vary as required.

Figure 7:
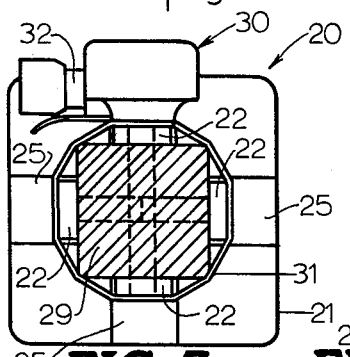
FIG. 7 is a top view of the leg extender with four braces secured to a small chair leg by a conventional band-type clamp.
Figure 9:
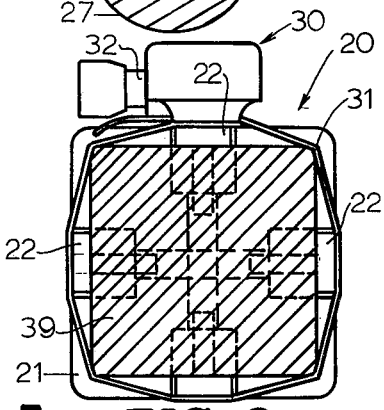
FIG. 9 is a top view of the leg extender as it is clamped to a large chair leg.
Figure 8:
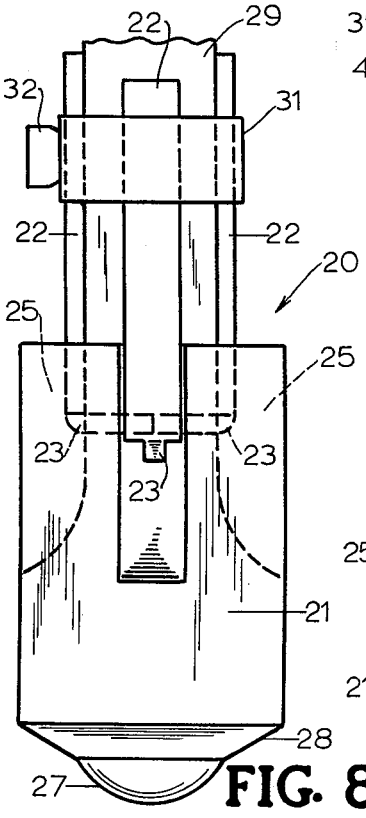
FIG. 8 is a side view of the leg extender and chair leg shown in FIG. 7.
Figure 10:
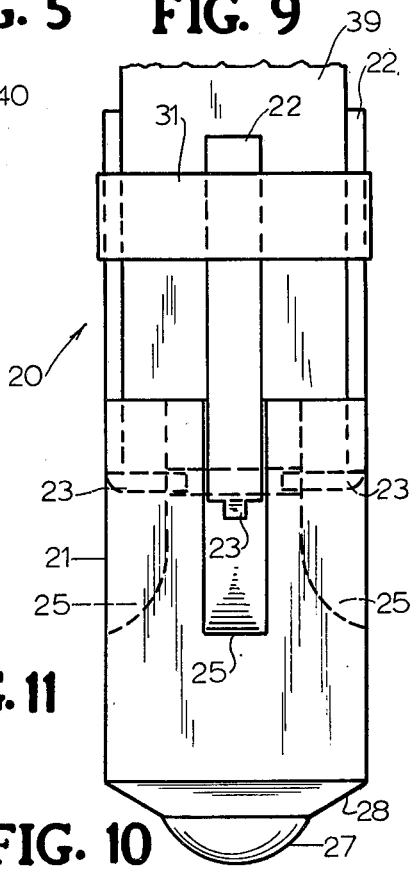
FIG. 10 is a side view of the leg extender shown in FIG. 9.

FIGS. 7 and 8 show leg extender 20 clamped to a relatively small chair leg 29. To accommodate leg 29, the tails 23 of braces 22 are fully inserted into the respective holes 26 so that interior surfaces of braces 22 extend vertically to contact the exterior surfaces of leg 29. Braces 22 are held securely against leg 29 by a band-type clamp 30 such as is used to clamp hose. Clamp 30 comprises a band 31 and tightening means 32. By tightening clamp 30, leg 29 is securely fastened to block 21 and the length of leg 29 is extended by the height of block 21. FIGS. 9 and 10 show the same leg extender 20 clamped to a larger chair leg 39. To accommodate leg 39, the tails 23 of braces 22 are only partially inserted into the respective holes 26 so that the braces can extend vertically to contact the exterior of the larger leg 39.

In one specific embodiment, block 21 is made of finished hardwood and has a square cross section measuring 1¾ inches on a side, and recesses 25 are cut 7/16 inch wide, 1½ inches long and 7/16 inch deep into each side. Braces 22 are made of metal, are ⅜ inch wide and 2⅜ inches long and have a thickness of ⅛ inch. The tails 23 are made 7/16 inch in length. Thus, block 21 and braces 25 can accommodate chair legs ranging in width, for example, from leg 29 (⅞ inch square leg) to leg 39 (1½ inches square leg). To accommodate legs ranging in width from 1½ inches to 2⅛ inches, a block 21 having a square cross section measuring 2⅜ inches on a side is provided. Thus, by providing only two block sizes, the present invention can be made useful to extend chair, bed and other furniture legs ranging in width from ⅞ inch to 2⅛ inches. it has been found that a substantial number of such legs fall within this range.

Since the bottom of the leg rests upon the top surface of block 21, the height of block 21 is the length by which the leg will be extended. Blocks 21 can be provided in heights ranging from two to six inches enabling the arthritic patient to elevate all of his beds, chairs, sofas, and other seats, to his comfort zone.

Leg extender 20 is adapted to receive chair and bed legs having virtually any shape cross section. Also, by slanting the braces 22 off of the vertical, it can be seen that leg extender 20 can receive tapered legs.

Figure 11:
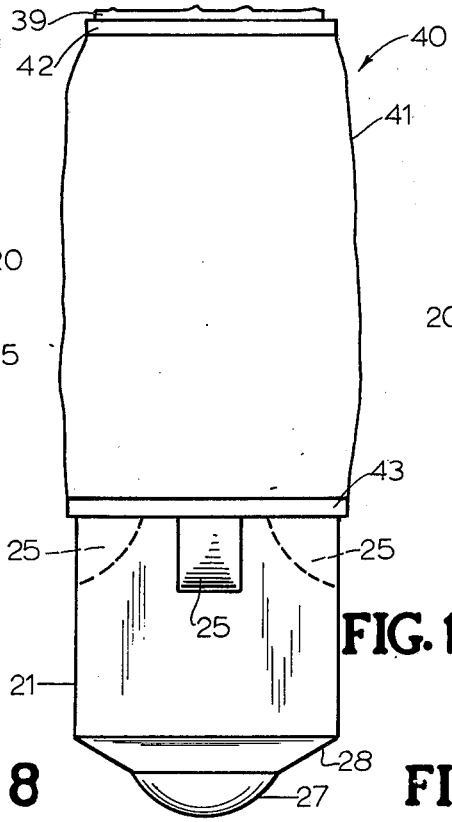
FIG. 11 is a side view of the leg extender and chair leg with the braces and clamp covered by a simulated leather sleeve for cosmetic purposes.

In order to cover up the metal brace and clamp members of leg extender 20, an open-ended, tubular sleeve 40 (FIG. 11) can be slid into place to cover the metal parts. Sleeve 40 comprises a tubular body made from simulated leather, knitted, or other pliable material and elastic rings 42 and 43 at each end of the body to hold sleeve 40 in place. Since block 21 is preferably made from finished wood, block 21 and sleeve 40, when suitably blended, give the leg extender 20 an attractive appearance.

In summary, leg extender 20 has been found to be a versatile and reliable means for extending the legs of beds and chairs for arthritic patients. The brace and band securement of leg extender 20 to the leg provides a very safe, inexpensive and simple extension and is much needed by such patients to elevate their furniture to their exact comfort zones.

I claim:

1. A device for extending the length of a leg on a conventional chair, bed or other furniture without altering the leg exterior surfaces comprising, in combination:

a. a block member having a plan or upper surface, sidewalls and a base surface for engaging a floor and having a plurality of recesses formed in said sidewalls and extending through said upper surface with each recess providing a horizontally aligned hole extending into the block;

b. a plurality of brace members equal to the number of said recesses, each brace having an elongated strip portion and having at one end of said strip portion a short tail extending perpendicular from said strip portion the remainder of said strip portion having no projections therefrom, said tail being adapted to slidably fit into a respective said recess horizontal hole so that said strip portion will extend vertically from said hole and above said block member top surface; and c. clamping means for urging said strip members inwardly towards one another and into engagement with the conventional leg exterior surfaces;

whereby the length of a chair, bed or other furniture leg may be extended by placing the end of said leg on said block member flat upper surface between said vertical strip members and securing said strip members to exterior portions of said leg by said clamping means.

2. The device of claim 1 wherein said clamping means comprises an adjustable band-type clamp.

3. A device for extending the length of a leg on a chair, bed or other furniture comprising, in combination:

a. a block member having a flat upper surface, sidewalls and a base surface and having a plurality of recesses formed in said sidewalls and extending through said upper surface with each recess providing a horizontally aligned hole extending into the block;

b. a plurality of brace members equal to the number of said recesses, each brace member having an elongated strip portion and having at one end of said strip portion a short tail extending perpendicular from said strip portion, said tail being adapted to slidably fit into a respective said recess horizontal hole so that said strip portion will extend vertically from said hole and above said block member top surface;

c. clamping means for urging said strip members inwardly towards one another; and d. A pliable, open-ended tubular sleeve having at each end thereof an elastic retainer, said sleeve being adapted to slide over and cover a portion of said device;

whereby the length of a chair, bed or other furniture leg may be extended by placing the end of said leg on said block member top surface between said vertical strip members and securing said strip members to exterior portions of said leg by said clamping means.

4. A system for elevating a chair, bed or other seat-type furniture comprising a selected number of extender members of equal length and corresponding to the number of legs on said chair, bed or other furniture, each extender comprising, in combination:

a. a block member having a substantially plan or upper surface, a floor engaging base surface and an outer periphery, said periphery including a plurality of spaced, horizontal holes extending into said block;

b. a plurality of brace members equal to the number of said horizontal holes, each brace member having an elongated strip portion and having proximate one end of said strip portion a short tail extending perpendicular from said strip portion the remainder of said strip portion having no projections therefrom, said tail being adapted to slidably fit into a respective said horizontal hole so that said strip portion will extend vertically from said hole and above said block member upper surface; and c. clamping means for urging said strip members inwardly towards one another and into contact with the exterior portions of said chair, bed or other furniture leg;

whereby said chair, bed or other furniture may be elevated by placing each leg thereof on a respective block member upper surface between said vertical strip members and securing said strip members to exterior portions of such leg by said clamping means.

5. The device of claim 4 wherein said clamping means comprises an adjustable band-type clamp.

* * * * *

UNITED STATES PATENT OFFICE

CERTIFICATE OF CORRECTION

Patent No. 3,985,323 Dated October 12, 1976

Inventor(s) Robert U. Gessler

It is certified that error appears in the above-identified patent and that said Letters Patent are hereby corrected as shown below:

Col. 2, line 36, "milledout" should be --milled-out--.

Col. 3, line 50, "plan or" should be --planar--.

Col. 3, line 57, --member-- should be inserted after "brace".

Col. 4, line 28, "A" should be --a--.

Col. 4, line 42, "plan or" should be --planar--.

Signed and Sealed this

Fifth Day of April 1977

[SEAL]

*Attest:*

RUTH C. MASON
*Attesting Officer*

C. MARSHALL DANN
*Commissioner of Patents and Trademarks*